United States Patent [19]

Barbe et al.

[11] 4,002,795

[45] Jan. 11, 1977

[54] CRIMPED YARNS AND METHOD FOR MAKING THEM

[75] Inventors: Gerard Barbe, St Didler au Mont d'Or; Robert Habault, Lyon; Jean-Louis Tamet, Besancon, all of France

[73] Assignee: Rhone-Poulenc Textile, France

[22] Filed: Aug. 29, 1975

[21] Appl. No.: 608,978

Related U.S. Application Data

[63] Continuation of Ser. No. 454,285, March 25, 1974, abandoned.

[30] Foreign Application Priority Data

Mar. 26, 1974 France ..... 74.11046

[52] U.S. Cl. ..... 428/370; 428/369; 428/374; 428/397

[51] Int. Cl.[2] ..... D02G 3/00; D02G 3/02

[58] Field of Search ..... 428/369, 370, 374, 394, 428/397; 264/171; 57/140 BY

[56] References Cited

UNITED STATES PATENTS

| | | | |
|---|---|---|---|
| 3,038,236 | 6/1962 | Breen | 264/171 |
| 3,039,524 | 6/1962 | Belck et al. | 428/374 |
| 3,180,912 | 4/1965 | Rowe | 264/171 |
| 3,492,692 | 2/1970 | Soda et al. | 264/171 |
| 3,547,763 | 12/1970 | Hoffman | 428/397 X |

FOREIGN PATENTS OR APPLICATIONS

| | | | |
|---|---|---|---|
| 812,099 | 8/1951 | Germany | |
| 1,196,275 | 6/1970 | United Kingdom | 264/171 |

*Primary Examiner*—Lorraine T. Kendell
*Attorney, Agent, or Firm*—Stevens, Davis, Miller & Mosher

[57] ABSTRACT

This invention provides yarns of randomly crimped filaments which are associated together into a substantially cylindrical yarn. The filaments are made by extruding two different synthetic organic polymers simultaneously through the same elongated orifice and the polymers are fed to different orifices in different proportions or at different angles with respect to the axes of the orifices so that in some of the filaments the interface between the two polymer layers is along or parallel to the smaller axis of the cross-section thereof while the interface of other filaments is along or parallel to the larger axis.

3 Claims, 23 Drawing Figures

CRIMPED YARNS AND METHOD FOR MAKING THEM

This is a continuation of application Ser. No. 454,285, filed Mar. 25, 1974 now abandoned.

This invention relates generally to synthetic fibers and more particularly to crimped synthetic yarns having a generally cylindrical appearance and made of bi-component filaments which develop a helical crimp.

These yarns having a generally cylindrical appearance are multifilament yarns the envelope of which resembles a sheath having a circular cross-section.

The production of bi-component yarns by extruding two different polymers through the same spinneret hole is described by U.S. Pat. No. 2,386,173. Yarns made of filaments capable of developing a helical crimp are thus obtained. In these yarns, however, the crimp of all of the filaments has the same pitch, this fact leading to yarns with a crimp which follows that of the filaments, so that the yarns are not cylindrical, a fact which may lead to difficulties for some applications.

U.S. Pat. No. 3,050,823 also describe the production of bi-component yarns by extruding through rectangular spinneret holes. Here again, all filaments have the same crimp since the distribution and the position of both components are the same for all filaments.

It is therefore an object of this invention to provide a yarn made up of randomly crimped synthetic filaments and having a generally cylindrical shape. Another object of the invention is to provide a method for making a yarn which is composed of a plurality of synthetic filaments having crimps of different pitches and has a substantially cylindrical appearance resembling that of yarns formed from natural fibers.

Other objects will become apparent from the following description with reference to the accompanying drawing wherein.

Figure 13:
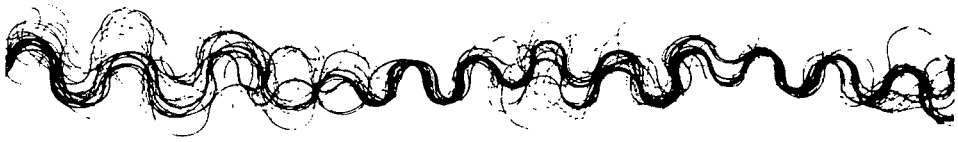
Figure 14:
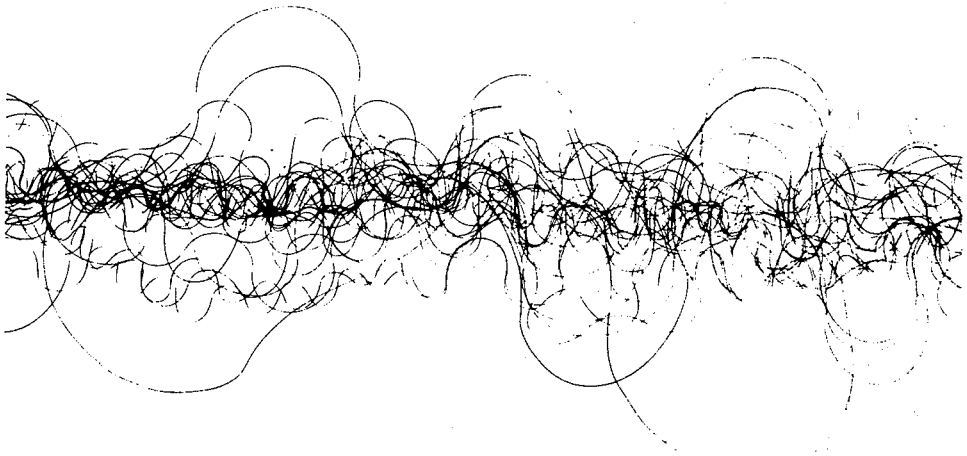
Figure 15:
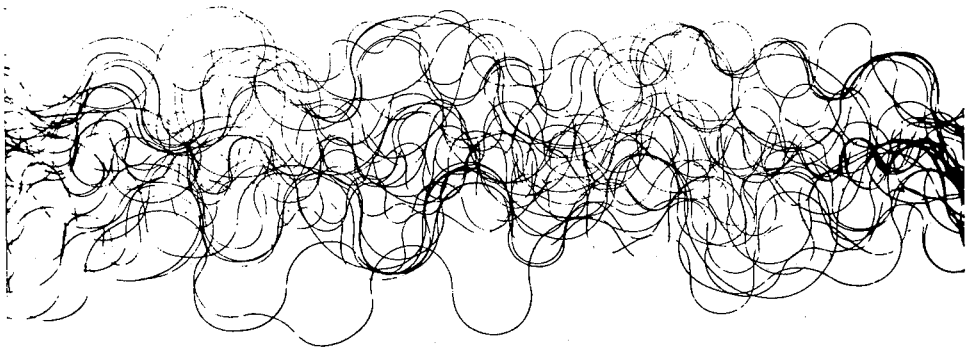
Figure 16:
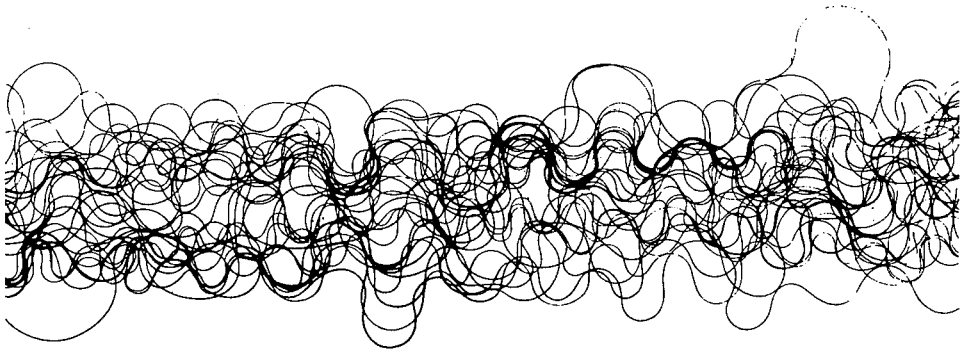
Figure 17:
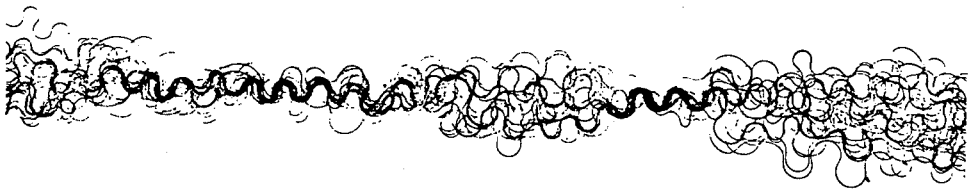
Figure 18:
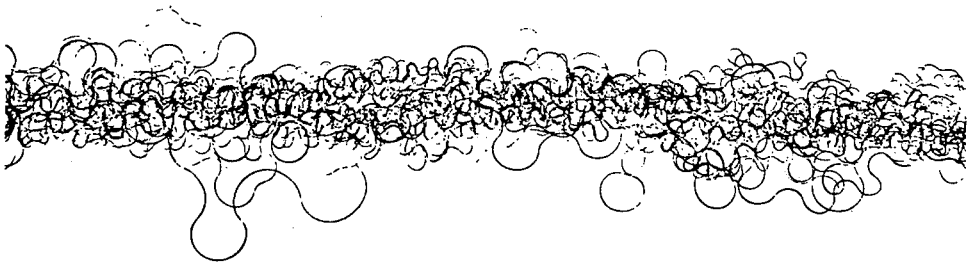
Figure 19:
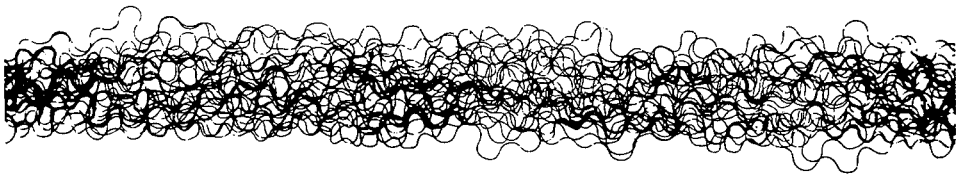
Figure 20:
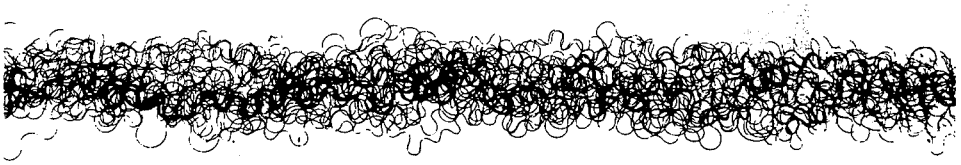

FIGS. 13, 14, 15 and 16 are reproductions of photographs of various yarns after a slight manual pre-tension to disentangle the filaments (Magnification: 4 ×) with FIG. 13 illustrating a bi-component yarn spun through circular spinneret orifices, FIG. 14 illustrates a bi-component yarn spun through rectangular spinneret orifices 0.70 × 0.13 mm., and FIG. 15 illustrating a bi-component yarn spun through rectangular spinneret orifices 0.50 × 0.18 mm.;

FIG. 16 illustrates a bi-component yarn spun through rectangular spinneret orifices 0.45 × 0.20 mm.; and FIGS. 17, 18, 19 and 20, respectively, illustrate the same yarns as FIGS. 13, 14, 15 and 16, but after having been submitted to a relaxation treatment to develop and set their crimp.

Figure 21:
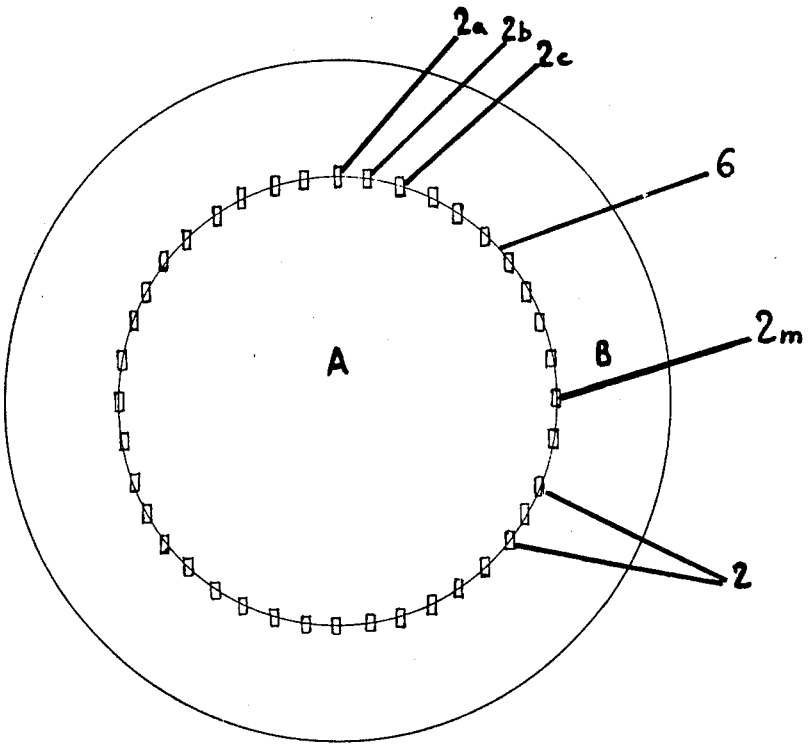

FIG. 21 represents another spinneret according to the present invention. This spinneret is pierced with rectangular shaped orifices, arranged parallel to each other on a ring 6. Thus, the interface between the compositions A and B lying along the ring is disposed differently from orifice to orifice, from the position 2*a* where the interface is disposed on the minor axis of the orifice to the position 2*m* where the interface is disposed on the major axis of the orifice.

Figure 22:
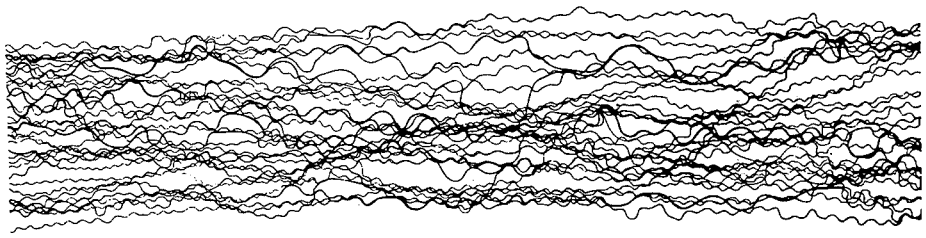
Figure 23:
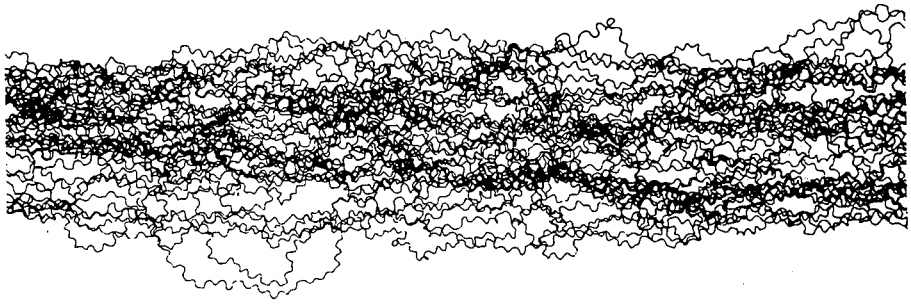

FIGS. 22 and 23 show yarns obtained by wet spinning of two solutions respectively through a spinneret pierced with circular orifices (FIG. 22) and through the spinneret of FIG. 21 (FIG. 23).

The foregoing objects and others are accomplished in accordance with this invention, generally speaking, by providing yarns composed of a plurality of filaments, each filament having been formed from two different polymers having different physical properties with the position of the interface between polymers varying from one filament to the other and with each filament having an elongated cross-section. The filaments are shaped in accordance with this invention by extruding two synthetic organic polymers with different shrinkage characteristics and moduli of elasticity through the same elongated spinneret orifice, the major axis of the spinneret being at least twice the minor axis, and with the dimensions and configuration of the layers of polymers in the resulting filament coming from one orifice being different from those of a filament coming from other orifices.

It has now been found that crimped multifilament yarns having a substantially cylindrical appearance can be made of two-component organic polymer filaments which have an elongated, cross-section and in which the position of the interface between the two polymers varies from that of one filament to that of another filament, so that yarns at one and the same time have at least two types of filaments: those in which this interface is disposed along or parallel to the minor or smaller axis and those in which this interface is disposed along or parallel to the major or larger axis of the cross-section.

Preferably, the yarns provided by the invention are not just composed of two filament types having different cross-sections but moreover are composed of several different types in which the interface is disposed along various oblique lines in relation to both axes of each filament. Yarns produced from such filaments have helical crimps of different pitch which leads to very randomly crimped filaments and to yarns having a substantially cylindrical appearance.

The method of producing such yarns provided by the invention involves extruding two spinnable synthetic compositions having different shrinkage characteristics and different moduli of elasticity of filaments made from them, in side by side relationship through elongated spinneret orifices, the ratio between the major axis and the minor axis being at least 2 to 1, the two compositions being supplied differently to different orifices in relation to the orientation of the orifices so that the interface between the compositions cuts the orifice cross-section along or parallel to the major axis of the cross-section of some orifices and the minor axis in others.

Preferably, in yet other orifices the interface is disposed along one or more lines that are oblique with respect to both main axes. It is usually advantageous to feed both the components in such a way that the most varied distribution of the two different components is obtained in the various filaments.

Any suitable pairs of spinnable synthetic organic polymers or compositions may be used to obtain the bi-component yarns with a natural crimp provided by the invention. For example, pairs of polymers of different compositions such as, homopolyamides and copolyamides with one component being polyhexamethylene diamine adipate or polycaprolactam and the other being a copolyamide prepared by the polycondensation of several diacids and/or diamines or lactams may be used. Likewise, different polyesters such as polyethylene terephthalate, on the one hand, and polybutylene terephthalate, on the other hand, or two similar polymers, one of which has been submitted to a chemical modification such as cross-linking, for example, copolymers having a basis of acrylonitrile differing from one another in nature and in the quantity of other comonomers besides the acrylonitrile forming a part of the copolymer or in their content of acid or basic milliequivalents may be used. Cellulosic polymers or components which are completely different in nature, such as a cellulosic polymer and a wholly synthetic polymer or a polyester component and a polyamide component may be used. The components may also be of the same chemical composition but with different physical properties, such as viscosity, temperature, degree of polymerization, etc.

To carry out the process according to the present invention either two molten polymers, or two spinning solutions, depending upon the material to be spun, are simultaneously spun through the same spinneret hole. The shape of the spinneret holes must be elongated, the ratio between the major axis and the minor axis being at least 2 to 1 and preferably 3 to 1.

Any elongated shape of the spinneret hole is suitable for practicing the present invention, such as, for example, rectangular, oval, C, T, I or Y shapes in which one of the bars for T, I and Y is markedly longer than the other or the others and in general, of any regular or irregular elongated shape. It is usually preferred that holes be rectangular in shape because it is easier to drill holes or orifices of this shape.

Figure 1:
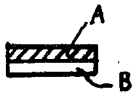
FIGS. 1, 2, 3 and 4 illustrate elongated orifices and the variety of possible distributions of the two polymer layers, A and B, the interface between layers being disposed along the major axis (FIG. 1) or the minor axis (FIG. 2), diagonally (FIG. 3) or obliquely (FIG. 4)
Figure 2:
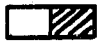
Figure 3:
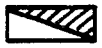
Figure 4:
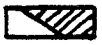
Figure 5:
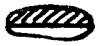
FIGS. 5, 6, 7 and 8 illustrate the different types of filaments spun through the spinneret orifices and with the distributions given in the FIGS. 1, 2, 3, 4 respectively.
Figure 6:
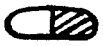
Figure 7:
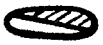
Figure 8:
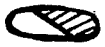
Figure 9:
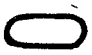
FIGS. 9, 10 and 11 illustrate other types of orifices which are elongated along one axis and which may be used according to the invention.
Figure 10:
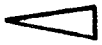
Figure 11:
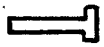
Figure 12:
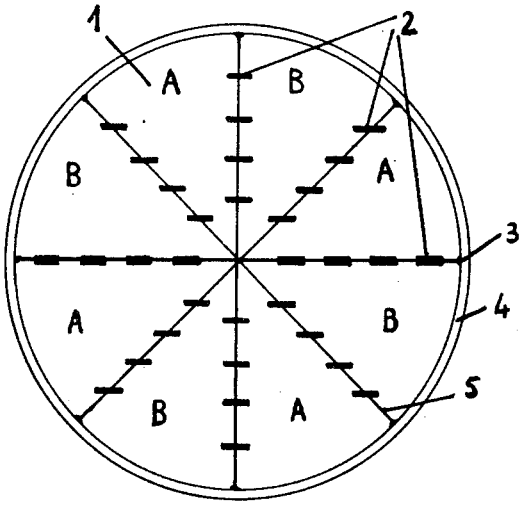
FIG. 12 is a sectional plan view of an embodiment of a spinneret pierced with rectangular orifices and provided with a distributor of spinnable polymer components.

The arrangement of holes on the spinneret depends upon the distribution of the components to be spun. If the distribution of the components to be spun is star-arranged as shown in FIG. 12, holes can be arranged so that their major axes are all parallel to each other. The same thing may occur when both components reach the spinneret in a concentric way. In this case, the interface of both components may be curved with respect to the hole axes without departing from the scope of the invention.

The synthetic resinous polymers may be spun by conventional melt spinning or wet or dry spun. Drawing of the filaments is also carried out in the way most suitable for the particular yarn being manufactured. The yarns may be steamed to develop the crimp.

Referring now to FIGS. 14, 15, 16 and 23 of the drawing, the filaments of the yarns produced by the invention are more randomly disposed or jumbled than are the filaments of the yarn of FIGS. 13 and 22 which were spun through spinneret orifices of circular cross-section. The crimp thus obtained looks much more like the natural crimp of wool than the crimp of the bi-component synthetic yarns known heretofore and it is particularly desirable in the textile world because of its appearance which is very close to that of natural fibers. Whereas a bi-component yarn usually has a helical crimp in which the crimp of all filaments has the same pitch and therefore have an inphase crimp development in the multifilament yarn, yarns according to the present invention have a cylindrical appearance due to the jumbling of the crimp of the various filaments, and this appearance is all the more pronounced as yarns are made of a greater number of filament types varying from each other by the arrangement of the polymer components of the filaments.

The Figures of the drawing illustrate distributions with identical proportions of both components. However, it is quite possible to use different proportions which may be, for example, 30–70% by weight of one component and 70–30% by weight of the other, without departing from the scope of the invention. Of course, in such cases, the interface is shifted. It is then parallel with the major axis on some filaments, parallel with the minor axis on others and possibly oblique on the last filaments.

FIG. 12 is a sectional plan view of a spinneret 1 pierced with rectangular orifices 2 and provided with a distributor 3 of spinnable components. This distributor consists of a circular part 4 connecting the spinneret to the upper part of the spinning head and of dividers 5 allowing the two spinnable components A and B to be separated above each spinneret hole 2. This figure shows that the spinneret holes are arranged in a different way with regard to dividers 5, so that the interface of components A and B come on the major axis of 8 holes, on the minor axis of 8 other holes and on an oblique line for the 16 other holes.

The following examples are given for the purpose of illustrating the invention and are not restrictive.

In these examples:

the intrinsec viscosity is determined from the solution viscosity measured at 25° C on a 1% by weight per volume solution of the polymer in o-chlorophenol, the stretch effect is given by:

stretch effect (%) $=L_1 - L_o / L_o \times 100$ in which $L_1$ represents the length of the yarn measured under a pre-tension of 50 mg/dtex and $L_o$ represents the length of the yarn under a pre-tension of 1 mg/dtex, the extensibility measured on an Instron dynamometer is given by the relationship $E\,\% = L - 1/1 \times 100$ in which L represents the length of the uncrimped yarn under a tension of 250 mg/dtex and 1 represents the length of the untensioned crimped yarn, half-uncrimping and half-recrimping forces are determined from the stress-strain diagram on Instron instrument for the interval 1 to L and are read as the abscissa corresponding to E %/2 on the ordinate in mg/tex, the crimp frequency is expressed in number of half-waves per cm of uncrimped fiber.

EXAMPLE 1

Polyethylene terephthalate (Intrinsic viscosity = 0.67 Melt viscosity = 2400 poises at 290° C) is melted at 300° C, and polybutylene terephthalate which is cross-linked with 0.3 mole % of trimethylolpropane (MV = 4200 poises at 260° C) is melted separately at 256° C.

Both molten polymers are passed through a heater at 280° C, then through a spinneret according to FIG. 12, heated at 270° C and pierced with 32 rectangular orifices whose capillaries measure 0.50 × 0.18 mm. The spinning speed is 1250 m/min. Yarns are sent at 135 m/min on a roll heated at 85° C and wound up at 405 m/min, so that the stretch ratio is 3 X. Yarns are then submitted to a relaxation treatment in a mixture of hot air and steam at 110° C at 450 m/min with a relaxation ratio of 19.6%.

Yarn characteristics measured on the various filament types are as follows:

Reference: 32 circular holes 0.34 mm in diameter
Ex 3: 32 rectangular holes 0.70 × 0.13 mm
Ex 4: 32 rectangular holes 0.50 × 0.18 mm
Ex 5: 32 rectangular holes 0.45 × 0.20 mm
Rectangular holes are arranged as in FIG. 12.

Yarns are then drawn at a ratio of 2.6 X.

Characteristics of yarn obtained are given in Table I indicating the number of filaments on which the measures have been carried out in each case.

TABLE I

| | Reference | Ex 3 | | | Ex 4 | | | Ex 5 | | |
|---|---|---|---|---|---|---|---|---|---|---|
| | | ① | ⊘ | ⊖ | ① | ⊘ | ⊖ | ① | ⊘ | ⊖ |
| Number of filaments | 4 | 4 | 4 | 3 | 4 | 4 | 4 | 4 | 4 | 4 |
| Counts dtex | 23.1 | 20.05 | 24.72 | 17.27 | 24.09 | 23.81 | 25.89 | 25.10 | 23.86 | 26.21 |
| Elongation % | 27.15 | 18.68 | 20.8 | 23.05 | 25.84 | 26.92 | 25.48 | 20.24 | 26.91 | 25.76 |
| Tenacity g/tex | 21.74 | 20.31 | 21.06 | 21.31 | 22.09 | 22.01 | 21.54 | 22.56 | 23.03 | 18.94 |
| Half-uncrimping force | 27.3 | 13.1 | 11.6 | 19.1 | 13.9 | 15.4 | 26.6 | 26.8 | 11.5 | 21.4 |
| Half-recrimping force | 21.7 | 8.6 | 9.2 | 16.2 | 11.5 | 13.4 | 21.5 | 19.3 | 11.1 | 17.2 |
| Extensibility | 139.2 | 23 | 61.4 | 159 | 57.6 | 48.3 | 117.9 | 73.6 | 63.2 | 125 |
| Crimp frequency | 10.71 | 4.97 | 7.19 | 10.53 | 7.04 | 9.52 | 8.54 | 8.91 | 7.21 | 7.54 |
| Stretch effect | 46.6 | 6.68 | 17.8 | 48.8 | 19.6 | 23.1 | 44 | 35.2 | 23.5 | 43.3 |

| types are as follows: | | | |
|---|---|---|---|
| Stretch effect | 10.5 | 21.5 | 46.4 |
| Crimp frequency | 1.7 | 3.5 | 4.7 |
| Half-uncrimping force | 45.9 | 90.9 | 86.8 |
| Half-recrimping force | 17.5 | 60.6 | 58.7 |
| Extensibility | 11.7 | 7.2 | 5.7 |
| Tenacity g/tex | 21.2 | 21.8 | 22.3 |
| Elongation % | 31.3 | 34.7 | 41.7 |

On the multifilament yarn, the crimping of the various filaments is randomly spaced or irregular.

EXAMPLE 2

The test of Example 1 is repeated with the same polymers and under the same conditions but with a draw ratio of 2.8 X.

Comparatively, the same polymers are spun under the same conditions but through a spinneret pierced with 32 circular orifices 0.34 mm in diameter.

The following table gives the characteristics of each of the three filament types spun through the rectangular spinneret orifices and measured on four filaments, of the multifilament yarn spun through these orifices and of the multifilament yarn through the circular spinneret orifices.

| | Filament types | | | Multifilament yarn | |
|---|---|---|---|---|---|
| | | | | ▭ | ○ |
| Count dtex | 22.6 | 22.2 | 23.4 | 180 | 174 |
| Elongation % | 14.7 | 17.1 | 17.4 | 20.8 | 24.1 |
| Tenacity g/tex | 23.8 | 24.0 | 24.0 | 23.1 | 25.2 |
| Stretch effect | 31.8 | 55.1 | 46.2 | 61.4 | 60.4 |
| Extensibility | 99.7 | 170 | 209 | 169 | 172 |
| Crimp frequency | 10.8 | 12.8 | 14.7 | 14.4 | 14.7 |
| | 8.8 | 10.5 | 11.2 | 11.3 | 10.1 |
| | 9.8 | 11.9 | 12.5 | 13 | 12 |
| Half-uncrimping force | 15.6 | 17.5 | 24.1 | 18.6 | 16.4 |
| Half-recrimping force | 11.1 | 12.9 | 19.0 | 11.0 | 7.74 |

EXAMPLES 3, 4 and 5

The same polymers as in Example 1 are melted, at 298° C for the polyethylene terephthalate and at 256° C for the polybutylene terephthalate. Then they are passed through a heater at 283° C and spun as in Example 1 with the following spinnerets:

FIGS. 13, 14, 15 and 16 are graphs with a magnification of 4 X of the yarns respectively spun through these four spinnerets: Reference, EX. 3, Ex. 4 and Ex. 5.

These Figures show that yarns of Examples 3, 4 and 5 have a randomly spaced crimp and are much more spread out or bulky than the reference yarn which has a regular crimp.

These four yarns have then been submitted to a treatment in a mixture of hot air and steam at 110° C at 450 m/min with a relaxation value of 19.6% to develop their crimp.

FIGS. 17, 18, 19 and 20 are graphs, also with a magnification of 4 X, respectively of the same yarns: Reference, Ex. 3, Ex. 4 and Ex. 5 after a relaxation treatment.

Likewise, these Figures show that yarns obtained according to Examples 3, 4 and 5 are much more regular in their width and their spreading or bulkiness than the reference yarn which show compact parts where all the filaments have an in-phase crimp development.

The yarns of this invention can be used to weave fabrics or other products where crimped filaments are conventionally employed.

Although the invention has been described in detail for the purpose of illustration it is to be understood that such detail is solely for that purpose and that variations can be made therein by those skilled in the art without departing from the spirit and scope of the invention except as it might be limited by the claims.

EXAMPLE 6

Two solutions are prepared in dimethylformamide:

one containing 22.8 % by weight of a copolymer made of 94.9 % by weight of acrylonitrile units, 3.5 % by weight of methyl ethacrylate units and 1.6 % by weight of potassiumvinyloxybenzenesulphonate units with a specific viscosity of 0.300, the other containing 22.35 % by weight of a copolymer made of 90.9 % by weight of acrylonitrile units, 8 % by weight of methyl methacrylate units and 1.1 % by weight of potassiumvinyloxybenzenesulphonate units with a specific viscosity of 0.310.

Both solutions are extruded at 130° C through the spinneret, shown in FIG. 21, pierced with 40 orifices of cross-section 0.05 × 0.10 mm arranged on a ring 8 mm in diameter, in a coagulating bath containing 40 % of dimethylformamide and 60 % of water at 20° C. The yarn obtained at 50 m/min is water-washed countercurrently, drawn at a ratio of 6 X in steam at 130° C, dried on a roll at 210° C and overdrawn when in the hot state at a ratio of 1.4 X.

Then, the yarn goes at 600 m/min through an air nozzle at 330° C which leads to a 20 % shrinkage. At last, it is submitted to steam at 130° C.

As a control, the same two solutions are extruded through a spinneret pierced with 40 circular orifices 0.08 mm in diameter distributed on a ring 8 mm in diameter and the obtained yarn treated on the same manner as above.

FIGS. 22 and 23 are photographs at a magnification of 4 X respectively of the control yarn and of the yarn of example 6.

These figures also show that the yarn of example 6 is much more spread out than the control yarn.

In the latter, (FIG. 22) several filaments, having an in-phase crimp development, appear as stuck together so that it seems as having a lower number of filaments than that of the FIG. 23 according to the invention though this number is 40 in the two cases.

What we claim is:

1. A crimped yarn having a substantially cylindrical appearance and comprising bi-component organic polymer filaments, each filament possessing an elongated cross-section, the position of the interface between the components in the cross-section varying from one filament to the other but remaining substantially the same throughout the length of the filament, whereby the yarn is formed from at least two filament types, one of said filament types having an interface which is substantially disposed along or parallel to the smaller axis and another of said filament types having an interface which is disposed along or parallel to the larger axis of the cross-section of the filament.

2. The yarn of claim 1 wherein at least three types of bi-component filaments are associated to form the yarn, the interface of one type being disposed along or parallel to the larger axis of the cross-section of the filament, the interface of a second type being along or parallel to the smaller axis of the cross-section of the filament, and the interface of the third type being disposed obliquely to both axes.

3. A synthetic yarn having a crimp which resembles that of natural fibers comprising randomly crimped organic polymer filaments of two layers of synthetic organic polymers having different shrinkage characteristics and moduli of elasticity, said layers being fused together and extending longitudinally throughout the length of the filament, each of said filaments having an elongated cross-section, an interface between said layers, the position of said interface in a cross-section of some of said filaments being disposed along or parallel to the larger axis of the filament throughout the length of the filament and the position of said interface in a cross-section of other of said filaments being disposed along or parallel to the smaller axis of the cross-section of the filament throughout the length of the filament, the association of filaments having differently positioned interfaces with randomly spaced crimps into a yarn producing a substantially cylindrical yarn.

* * * * *